US007025046B2

(12) United States Patent
Ikeda et al.

(10) Patent No.: US 7,025,046 B2
(45) Date of Patent: Apr. 11, 2006

(54) INTAKE STRUCTURE IN INTERNAL COMBUSTION ENGINE

(75) Inventors: Kenichiro Ikeda, Wako (JP); Kenji Oki, Wako (JP); Nobuhiro Shimada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/970,858

(22) Filed: Sep. 24, 2004

(65) Prior Publication Data

US 2005/0109321 A1 May 26, 2005

(30) Foreign Application Priority Data

Sep. 30, 2003 (JP) ..... 2003-342321

(51) Int. Cl.
*F02M 1/00* (2006.01)

(52) U.S. Cl. ..... 123/470; 123/308

(58) Field of Classification Search ..... 123/470, 123/308, 432, 294–305
See application file for complete search history.

(56) References Cited

U.S. PATENT DOCUMENTS 5,819,706 A * 10/1998 Tsuchida et al. ..... 123/432
6,055,958 A * 5/2000 Aoyama et al. ..... 123/308

FOREIGN PATENT DOCUMENTS

JP 2001-138975 5/2001

* cited by examiner

*Primary Examiner*—John T. Kwon
(74) *Attorney, Agent, or Firm*—Hamre, Schumann, Mueller & Larson, P.C.

(57) ABSTRACT

A fuel injection device is installed in a cylinder head of an internal combustion engine in such a manner that a fuel injection port thereof faces a curved intake passage formed in the cylinder head. Fuel is injected from the fuel injection device directly toward a wall surface of the intake passage without aiming at an intake port.

17 Claims, 12 Drawing Sheets

FIG. 9A
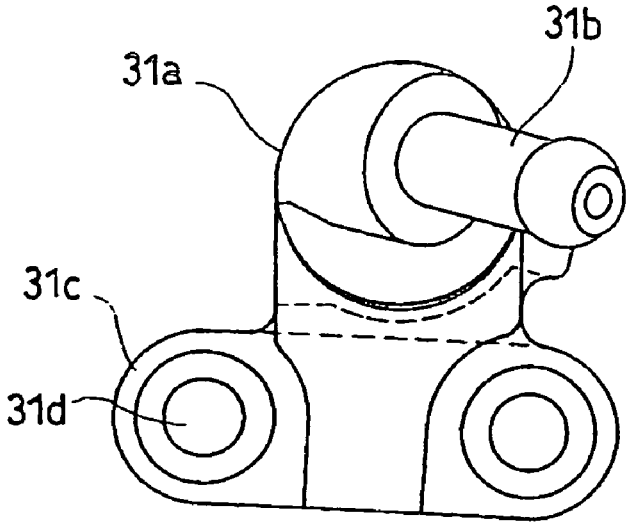
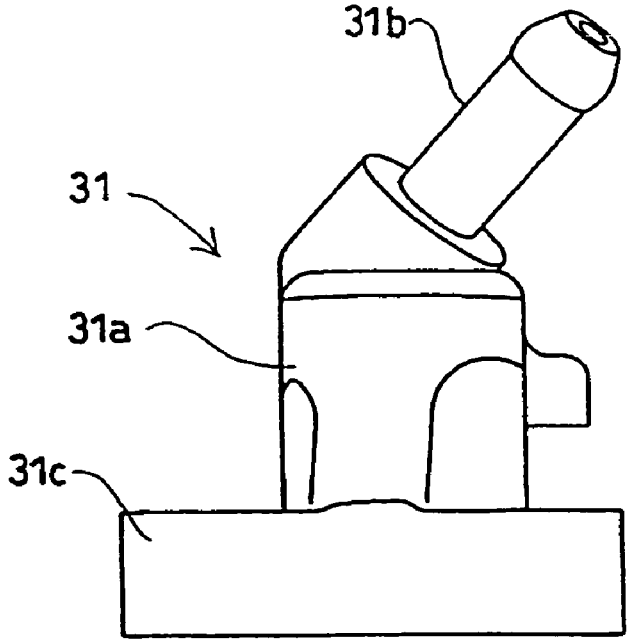
FIG. 9B

PRIOR ART

INTAKE STRUCTURE IN INTERNAL COMBUSTION ENGINE

TECHNICAL FIELD

The present invention relates to an intake structure in an internal combustion engine and, more particularly, to an intake structure for a fuel injection device in an internal combustion engine of a motorcycle.

BACKGROUND ART

A conventional fuel injection device mounting structure in an intake structure of an internal combustion engine is known. A fuel injection device is installed in a cylinder head so as to face a generally U-bent intake passage. A fuel injection orifice in the fuel injection device thus installed in the cylinder head in a facing relation to the intake passage is oriented toward an intake port, which is an opening of the intake passage in a combustion chamber. Fuel injection is aimed directly at a valve head of an intake valve in a closed state of the intake port. See, for example, FIG. 9 of Japanese Patent Laid-open No. 2001-138975.

A fuel injection device 014 of an internal combustion engine in a motorcycle configured as disclosed in Japanese Patent Laid-open No. 2001-138975 is illustrated in FIG. 12. The fuel injection device 014 is installed in a cylinder head 01 in such a manner that a fuel injection orifice 014*a* thereof faces a curved top portion 012*d* of a generally U-bent intake passage 012 formed in the cylinder head 01. The fuel injection device 014 is installed in the curved top portion 012*d* in such a manner that the axis thereof intersects the curved top portion 012*d* at a predetermined angle.

Once the fuel injection device 014 is installed in accordance with such a disposing structure, the injection of fuel is oriented toward an opening of the intake passage 012 in a combustion chamber 011, that is, toward an intake port 012*a*. To be more exact, the injection of fuel is aimed directly at a portion corresponding to the head of an intake valve 012*b* in a state in which the valve closes the intake port 012*a*.

However, this injection of fuel aiming directly at the head of the intake valve in the intake port in the installed state of the fuel injection device can be disadvantageous for the following reasons. In an internal combustion engine having an overlap of opening and closing of valves, that is, in an engine wherein valves perform opening and closing motions such that an exhaust valve has not yet closed an exhaust port completely when an intake valve begins to open an intake port, injected fuel blows together with air toward the exhaust port simultaneously with opening of the intake port. A portion of the injected fuel is discharged together with exhaust gas through an exhaust passage from the exhaust port.

Such a portion of the injected fuel discharged together with exhaust gas through the exhaust passage results in an increase in the amount of HC contained in the exhaust gas. It is necessary to install a secondary air introducing device and an exhaust gas treating device such as CAT to prevent such an increase in the amount of HC contained in the exhaust gas and for decreasing the amount of HC. Post-treatment of the exhaust gas with use of these devices is therefore important.

One countermeasure for preventing such blowing of injected fuel may be the adoption of means performing fuel injection after the completion of an overlapped state of both intake and exhaust valves. However, since the adoption of such means retards the fuel injection timing by the fuel injection device, the injection of fuel is not completed within the opening time of the intake port by the intake valve. That is, the injection of fuel by the fuel injection device is not completed until complete closure of the intake port by the intake valve.

SUMMARY

The present invention relates to an improvement of an intake structure in a fuel injection device mounting structure.

According to one aspect, the present invention relates to an intake structure in an internal combustion engine including a cylinder head, a combustion chamber in the cylinder head, an intake port and an exhaust port in the combustion chamber, an intake passage and an exhaust passage communicating with the intake port and the exhaust port, respectively, and an intake valve and an exhaust valve for opening and closing the intake port and the exhaust port in the intake passage and the exhaust passage, respectively. A fuel injection device is installed in the cylinder head with a fuel injection orifice thereof facing the intake passage. The fuel injection orifice is positioned in proximity to the intake valve for opening and closing the intake port in such a manner that the direction of fuel injection from the fuel injection device intersects the intake port.

The intake passage communicating with the intake port is formed in a U-like bent state, the fuel injection orifice of the fuel injection device faces a top portion of the intake passage, and an axis of the fuel injection device runs substantially in parallel with a valve axis of the intake valve. The intake passage branches from a single intake passage into a plurality of ports, and the fuel injection orifice of the fuel injection device is positioned in proximity to the branched portion of the intake passage. Further, the internal combustion engine having the intake structure is mounted on a vehicle in such a manner that a cylinder thereof assumes a horizontal state, and the vehicle with the internal combustion engine mounted thereon is a scooter type vehicle having a receptacle disposed over an intake system for the horizontal cylinder in the internal combustion engine.

According to another aspect, the invention relates to an intake structure in an internal combustion engine wherein a fuel injection device is installed in the cylinder head with a fuel injection orifice thereof facing the intake passage, the fuel injection orifice being positioned in proximity to the intake valve for opening and closing the intake port in such a manner that the direction of fuel injection from the fuel injection device intersects the intake port.

According to another aspect, the intake passage communicating with the intake port is formed in a U-like bent state, the fuel injection orifice of the fuel injection device faces a top portion of the intake passage, and an axis of the fuel injection device runs substantially in parallel with a valve axis of the intake valve.

According to another aspect, the intake passage branches from a single intake passage into a plurality of intake ports, and the fuel injection orifice of the fuel injection device is positioned in proximity to the branched portion of the intake passage.

According to another aspect, the internal combustion engine having the intake structure is mounted on a vehicle in such a manner that a cylinder thereof assumes a horizontal state, and the vehicle with the internal combustion engine mounted thereon is a scooter type vehicle having a receptacle disposed over an intake system for the horizontal cylinder in the internal combustion engine.

BRIEF DESCRIPTION OF THE DRAWINGS

FIG. 8(*b*) is a sectional view taken on line B—B in FIG. 8(*a*).

FIG. 9 illustrates a fuel injection device mounting member according to the present invention.

DETAILED DESCRIPTION

In an intake structure of a horizontally internal combustion engine in a motorcycle configured in accordance with principles of the present invention, a fuel injection device is installed in an intake passage of the intake structure in such a manner that fuel is injected toward a wall surface of the intake passage without directly aiming at an intake port.

Figure 1:
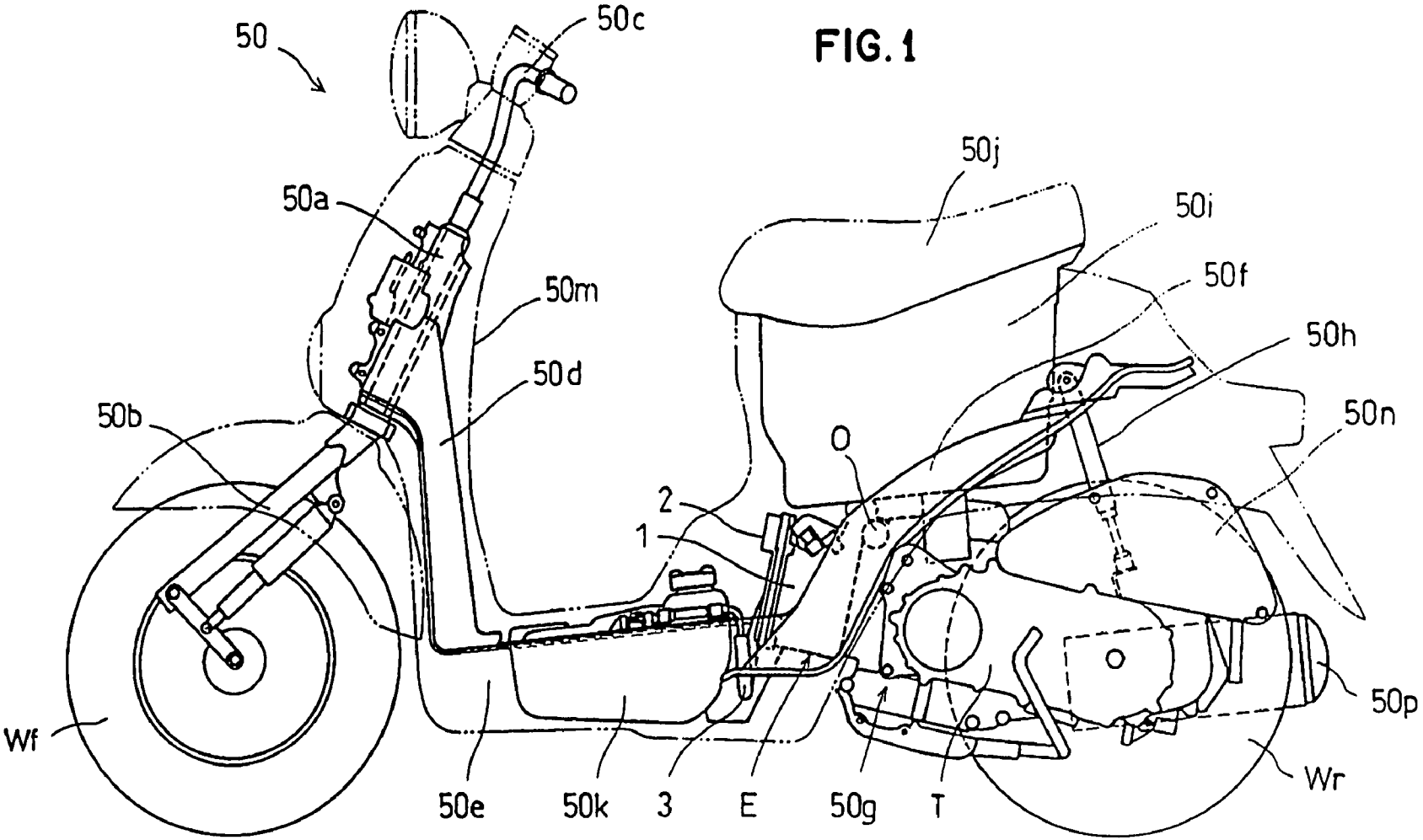
FIG. 1 illustrates a motorcycle with an internal combustion engine mounted according to the present invention.

FIG. 1 is a left side view of a motorcycle 50 according to the present invention. In the illustrated embodiment, the motorcycle is a scooter-type vehicle. This vehicle includes, as components of a vehicle body frame structure thereof, a head pipe 50*a*, a front fork 50*b* secured to the head pipe 50*a*, a front wheel Wf secured to the front fork 50*b*, a handle 50*c* connected to the front fork 50*b*, a pair of down frames 50*d* substantially branched and extending downward from the head pipe 50*a*, a pair of floor support frames 50*e* extending backward from lower ends of the down frame 50*d*, and a pair of rear frames 50*f* as main frames connected to the floor support frames 50*e* and inclined backwardly upward.

A front upper portion of a power unit 50*g* is secured to the rear frames 50*f* vertically swingably through a fulcrum portion 0. The power unit 50*g* is a swing type power unit. A rear wheel Wr is secured to a rear portion of the power unit 50*g* and rear suspensions 50*h* for suspending the power unit 50*g* are secured to rear upper portions of the rear frames 50*f*. Further, a goods receptacle 50*i* is mounted on top of the rear frames 50*f*, and a seat 50*j* is mounted on to top of the goods receptacle 50*i*. Thus, the power unit 50*g* is disposed under the goods receptacle 50*i*. A fuel tank 50*k* is disposed on the floor support frames 50*e*, and the greater part of the vehicle body frame is covered with a body cover 50*m*.

The goods receptacle 50*i* mounted on top of the rear frames 50*f* is a receptacle box for receiving therein various goods, e.g., helmet. The power box 50*g* disposed under the goods receptacle 50*i* has a structure in which an internal combustion engine E located on the front side and a continuously variable transmission T located on the rear side are rendered integral with each other. The internal combustion engine E is a single cylinder, four-cycle, water-cooled engine and is disposed on the vehicle in a substantially horizontal state in which a cylinder thereof faces the front side of the vehicle body. The continuously variable transmission T is a belt type transmission, for example. Numeral 50*n* denotes an air cleaner, and numeral 50*p* denotes a muffler.

Although only a part of the internal combustion engine E is shown in FIG. 1, the engine E includes, as known well, a crank case, a cylinder block connected to the crank case, a cylinder head 1 connected to the cylinder block, and a cylinder head cover 2 connected to the cylinder head 1. According to an internal structure of the internal combustion engine E, a crank shaft is supported rotatably within the crank case, and a piston reciprocates through a cylinder bore through a connecting rod connected to a crank pin of the crank shaft. The cylinder bore is formed in the cylinder block.

Figure 5:
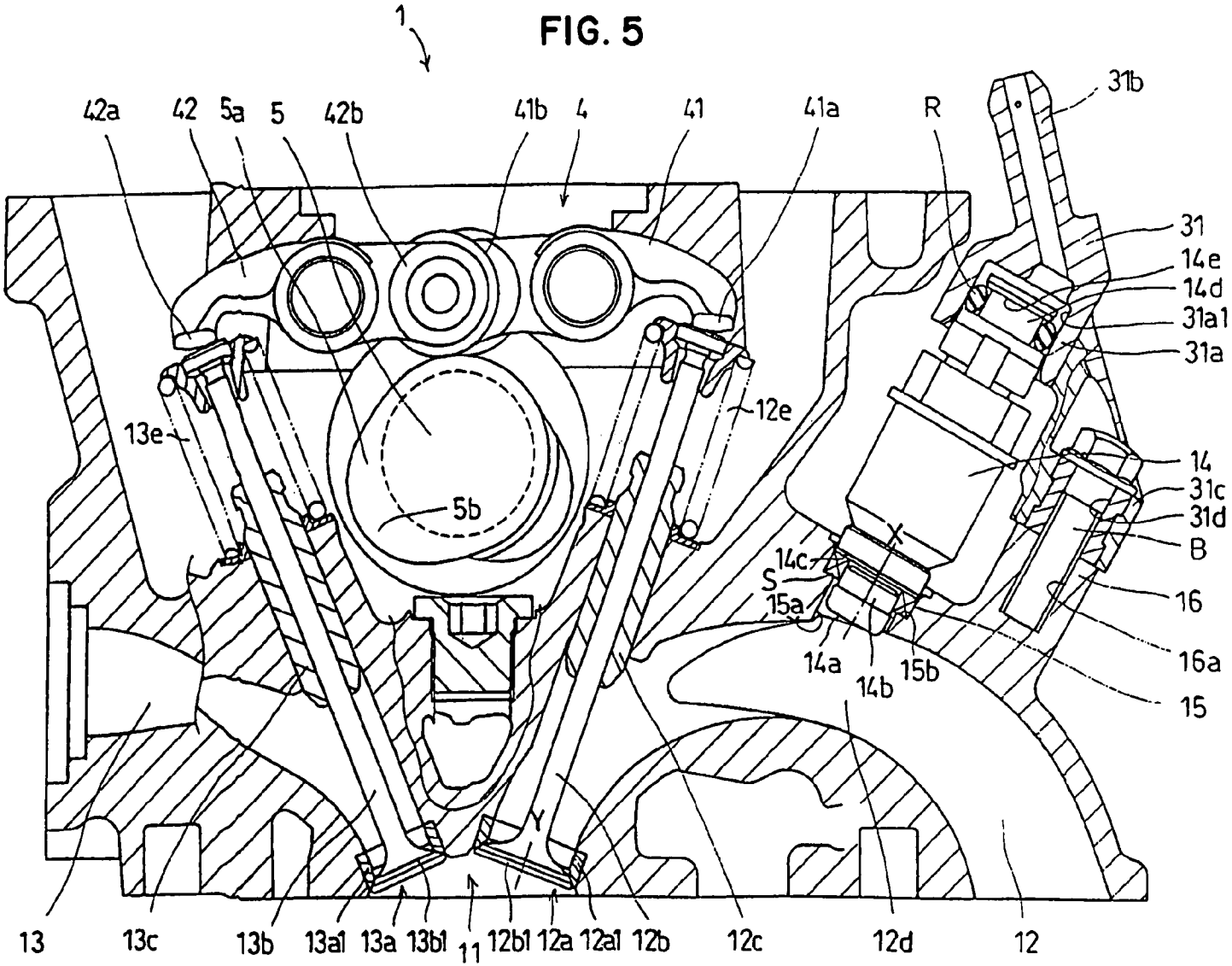
FIG. 5 illustrates the cylinder head according to the present invention, with various components being installed in the block of the cylinder head.

As can be seen by reference to FIG. 5, a combustion chamber 11 is formed in the cylinder head 1 in adjacency to a connection of the cylinder head with the cylinder block, and a spark plug (not shown) is disposed in the combustion chamber 11. Moreover, intake and exhaust ports 12*a* and 13*a* communicating with intake and exhaust passages 12, 13, intake and exhaust valves 12*b* and 13*b* for opening and closing the intake and exhaust ports 12*a* and 13*a*, and a valve operating mechanism for the intake and exhaust valves, are disposed in the combustion chamber 11. Further, a fuel injection device 14 for supply fuel to the combustion chamber 11 through the intake passage 12 is installed in the cylinder head 1 with a fuel injection port 14*a* thereof facing the intake passage 12.

As shown in FIG. 1, the cylinder head cover 2 forms a foremost portion of the internal combustion engine E mounted horizontally on the motorcycle 50, and the fuel tank 50*k* is disposed on the floor support frames 50*e* located in front of the cylinder head cover 2. Fuel is supplied from the fuel tank 50*k* through a fuel supply hose 3 to the fuel injection device 14 installed in the cylinder head 1. A fuel pump P is disposed in the interior of the fuel tank 50*k*.

Figure 2:
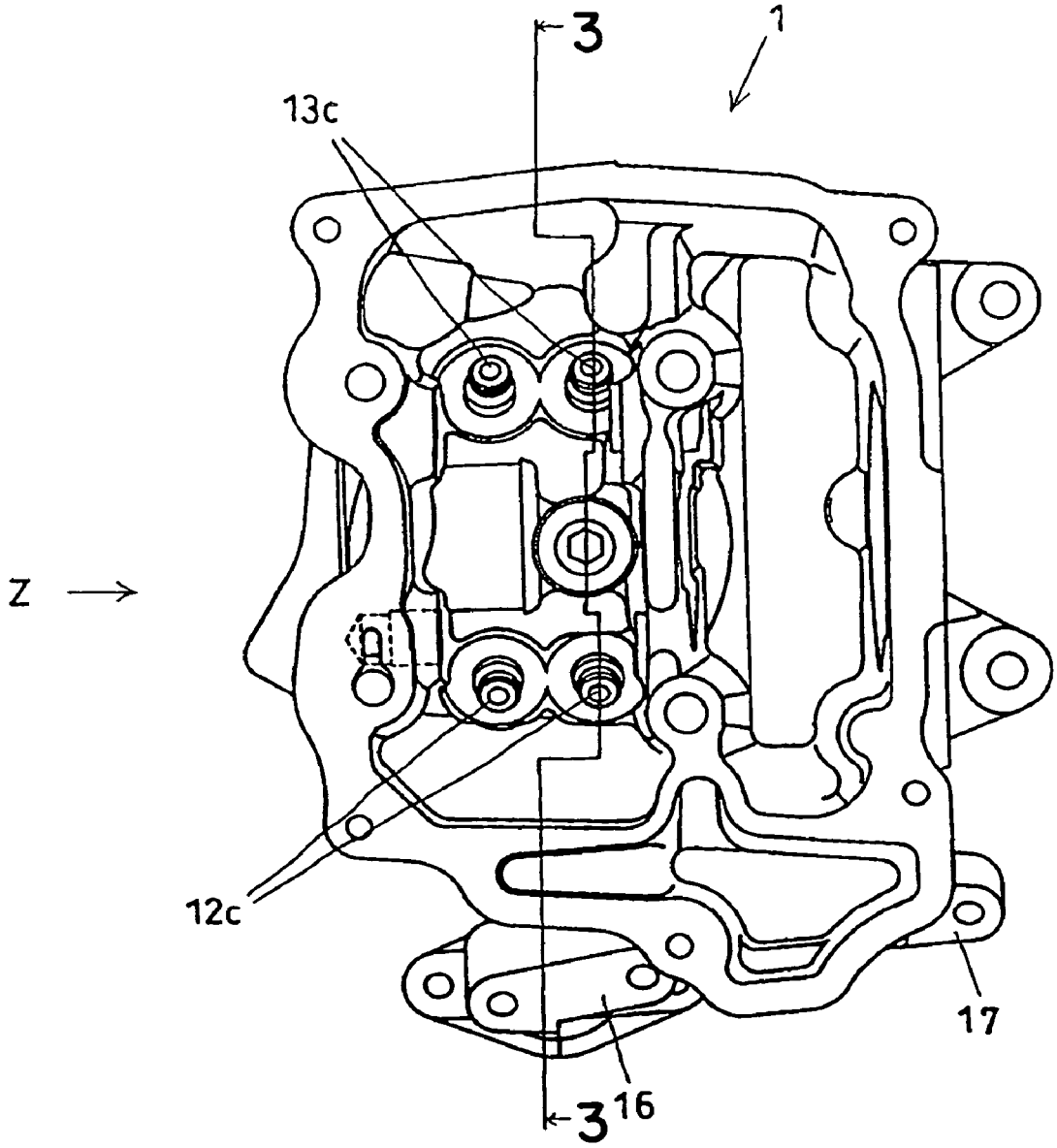
FIG. 2 illustrates a block structure of a cylinder head according to the present invention.

An upper surface (front side) of a block of the cylinder head 1 is illustrated in FIG. 2. When assembling the engine, the cylinder head cover 2 is mounted onto the block shown in FIG. 2. In the same figure, a block of the cylinder head 1 having a generally rectangular external shape is shown. Upper end portions of stem guides 12*c* and 13*c* for guiding the mounting of stem portions of two intake valves 12*b* and two exhaust valves 13*b* (see FIG. 5) are clearly shown in a generally central part of the block.

The lower two stem guides 12*c* in FIG. 2 are for the intake valves 12*b*, while the upper two stem guides 13*c* are for the exhaust valves 13*b*. On the lower side, a mounting seal 16 for fixing a mounting member 31, which is for mounting the fuel injection device 14 and which will be described later, is shown. Further shown is a hose holder mounting portion 17 for the fuel supply hose 3, which is not shown in FIG. 2.

Figure 3:
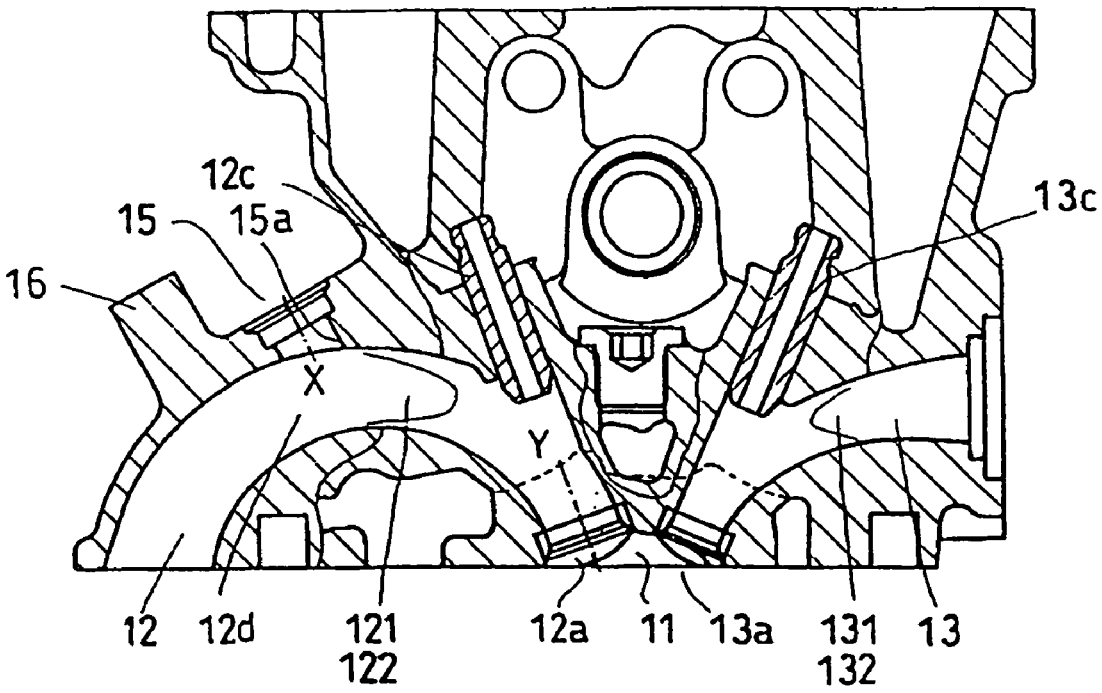
FIG. 3 is a sectional view taken on line A—A in FIG. 2, illustrating a block structure of the cylinder head according to the present invention.

The intake passage 12 and the exhaust passage 13, both extending through the interior of the block of the cylinder head 1, are shown in FIG. 3, which is a sectional view taken on line A—A in FIG. 2. The intake passage 12 and the exhaust passage 13 branch halfway into two branch passages 121, 122 and two branch passages 131, 132, respectively. The branch passages 121, 122, 131, and 132 are open in the combustion chamber 11 shown on the lower side. These openings substantially form the intake and exhaust ports 12*a* and 13*a*. Further, the valve stem guides 12*c* and 13*c* for disposing the intake and exhaust valves 12*b* and 13*b*, which are not shown in FIG. 3, within the intake and exhaust ports 12*a* and 13*a* are provided within the block of the cylinder head 1 so as to extend while aiming at the intake and exhaust ports 12*a* and 13*a*.

The intake passage 12 and the exhaust passage 13 extend within the block of the cylinder head 1 while creating respective curvilinear shapes. Particularly, the intake passage 12 extends curvilinearly through the cylinder head block 1, creating a generally U-shaped curve. Outside the block of the cylinder head 1, the intake passage 12 thus extending through the same block is connected to the air cleaner 50*n* through an inlet pipe and a connecting pipe (neither shown). A throttle is mounted in the connection between the inlet pipe and the connecting pipe. Further, outside the block, the exhaust passage 13 is connected to the muffler 50*p* through an exhaust pipe (not shown).

In the intake passage 12, a mounting seat 15 for mounting the fuel injection device 14 is provided at a position corresponding to a curved top portion 12*d* of the curved and U-shaped intake passage 12 and near the position just before the branched point of the passage. An injection device mounting hole 15*a* is formed in the mounting seat 15. As shown in FIG. 2 and as described earlier, the mounting seat 16 for mounting the fuel injection device 14 is formed in the block of the cylinder head 1. The mounting seat 15 holds a lower portion of the fuel injection device 14, while the mounting seat 16 holds an upper portion of the fuel injection device through the mounting member 31 (see FIGS. 5 and 9).

The hole 15*a* opens to the intake passage for mounting the injection device 14. The intake port 12*a* of the intake passages opens in the combustion chamber 11. An axis X of the hole 15*a* and an axis Y of the intake port 12*a* extend in a mutually deviated and nearly parallel relation. Consequently, the fuel injection device 14 is mounted such that the direction of fuel injection from the fuel injection device 14 deviates from the intake port 12*a* of the intake passage 12. That is, the fuel from the fuel injection device is not directly injected to the intake port 12*a* of the intake passage 12.

Figure 4:
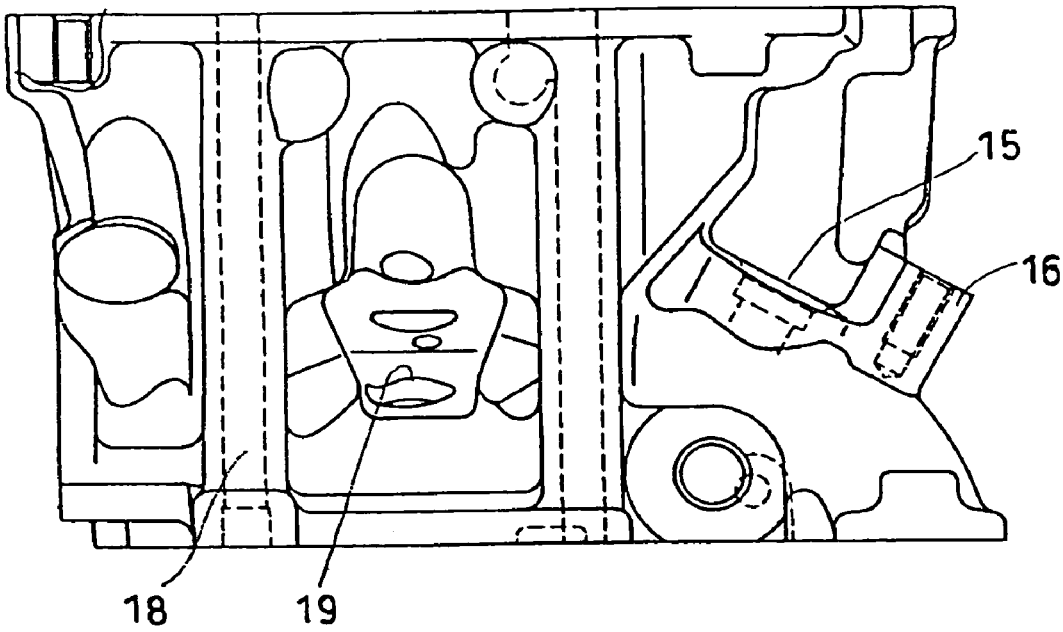
FIG. 4 is a view as seen in the direction of arrow Z in FIG. 2, illustrating the block structure of the cylinder head according to the present invention.

FIG. 4 is a left side view in FIG. 2 (as seen in the direction of arrow Z) of the block of the cylinder head 1. In FIG. 4, the mounting seats 15 and 16 for mounting the fuel injection device 14 are shown on the right side. A mounting hole 19 for mounting a spark plug (not shown) is formed in a central lower position of the block of the cylinder head 1. Holes 18 are provided for stud bolts, which extend vertically through the cylinder head 1. The mounting hole 19 is sandwiched in between the holes 18.

In assembling the engine E, as noted earlier and as known well, various components, including intake and exhaust valves 12*b* and 13*b*, a valve operating mechanism including rocker arms 4 and a cam shaft 5 for operating the valves 12*b* and 13*b*, a spark plug, and the fuel injection device 14, are installed in the block of the cylinder head 1.

FIG. 5 shows the block of the cylinder head 1. Valve stems of the two intake valves 12*b* and the two exhaust valves 13*b* are inserted into the valve stem guides 12*c* and 13*c*, respectively. Valve faces 12*b*1 and 13*b*1 of valve head outer peripheries located at lower portions of the valves are opposed to valve seats 12*a*1 and 13*a*1 of the intake and exhaust ports 12*a* and 13*a*. The valve faces 12*b*1 and 13*b*1 can be brought into and out of contact with the valve seats 12*a*1 and 13*a*1. Valve springs 12*e* and 13*e* are disposed on upper portions of the valve stems.

Biasing forces of the valve springs 12*e* and 13*e* urge the intake and exhaust valves 12*b* and 13*b* upward. Upper ends of the valve stems confront ends 41*a* and 42*a* of rocker arms 41 and 42 corresponding to respective valves 12*b* and 13*b*. In a state in which opposite ends 41*b* and 42*b* of the rocker arms 41 and 42 are not in abutment against a projecting portion 5*b* of a cam portion 5*a* of the cam shaft 5 (to be described below), the valve stem upper ends clear ends 41*a* and 42*a*. With this clearance, it is possible to minimize the issue of valve closure during thermal expansion.

The opposite ends 41*b* and 42*b* of each rocker arm 41 and 42 are in abutment against the cam portion 5*a* of the cam shaft 5. When the opposite ends 41*b* and 42*b* are not in contact with the projecting portion 5*b* of each cam portion 5*a*, the rocker arms 41 and 42 assume the illustrated state. The intake and exhaust ports 12*a* and 13*a* are closed with the intake and exhaust valves 12*b* and 13*b* in a state in which the valve faces 12*b*1 and 13*b*1 of the head outer peripheries of the valves 12*b* and 13*b* are in contact with the valve seats 12*a*1 and 13*a*l.

When the opposite ends 41*b* and 42*b* of the rocker arms 41 and 42 are in contact with the projecting portion 5*b* of the cam portion 5*a*, the rocker arms 41 and 42 turn a predetermined quantity. A depressing motion of the valve step upper ends caused by the rocker arms 41 and 42 moves the valve faces 12*b*1 and 13*b*l of the valve head outer peripheries away from the valve seats 12*a*l and 13*a*l, whereby the intake and exhaust ports 12*a* and 13*a* are opened. Opening and closing motions of the intake and exhaust ports 12*a* and 13*a* by the intake and exhaust valves 12*b* and 13*b* are performed in synchronism with intake and exhaust strokes in the known four-cycle strokes, of course.

The fuel injection device 14 is installed in the cylinder head 1 in such a manner that its injection port 14*a* faces the curved top portion 12*d* of the intake passage 12 in the vicinity of the branched point of the passage. The intake passage 12 is shown as a U-shaped curved portion on the right side in FIG. 5. The fuel injection device 14, when thus mounted, is held in the hole 15*a* of the mounting seat 15 in a state in which its injection port 14*a* faces the interior of the intake passage 12 without projecting from the inner wall surface of the intake passage 12. The hole 15*a* is formed near the curved top portion 12*d* of the intake passage 12. More specifically, the fuel injection device 14 is mounted and held as follows.

A lower portion 14*b* of the fuel injection device 14 is pushed through a sealing member S into the hole 15*a* of the mounting seat 15 formed in the cylinder head 1, and a stepped portion 14*c* of the lower portion 14*b* of the fuel injection device is brought into abutment through the sealing member S against a stepped portion 15*b* of the hole 15*a* formed in the mounting seat 15. The injection valve 14 is held on the mounting seat 15. Next, an upper portion 14*d* of the fuel injection device 14 is fitted and held within a fitting hole 31*a*l of the fuel injection device mounting member 31 such that the mounting member 31 covers the upper portion 14*d*.

More specifically, the upper portion 14*d* of the injection valve 14 is press-fitted into the fitting hole 31*a*l of the fuel injection device mounting member 31 in a state in which an O-ring R is fitted in a constricted portion 14*e* formed in the upper portion 14*d*. A fixing portion 31*c* of the mounting member 31 is clamped with bolt B and fixed to the mounting seat 16 by utilizing a bolt hole 31*d* formed in the fixing portion. The mounting seat 16 is a part of the block structure of the cylinder head 1. In this way, the fuel injection device 14 is installed in the cylinder head 1. Additional details of the fuel injection device mounting member 31 are shown in FIG. 9.

In the manner described above, the fuel injection device 14 is installed in the cylinder head 1. The hole 15*a* permits the fuel injection device 14 to be disposed so that the fuel injection port 14*a* faces the interior of the intake passage 12. The hole 15*a* is formed in such a positional relation that, as noted earlier, the axis X thereof is nearly parallel to but is deviated from the axis Y of the intake port 12*a* without aiming at the intake port 12*a*. Therefore, the fuel injection port 14*a* disposed in the mounting hole 15*a* is also in the aforesaid relation. Consequently, the fuel injected from the fuel injection port 14*a* does not advance directly toward the intake port 12*a*, but strikes directly against the wall surface of the intake passage 12 at a predetermined angle of inclination.

This mounting structure for the fuel injection device 14 can assist in minimization of the blow-through phenomenon of injected fuel, as will be described later. Moreover, in the internal combustion engine E adapted to perform swing motions in a horizontally installed state, it is possible to suppress the amount of an outward projecting quantity of the fuel injection device from the upper portion of the engine. Consequently, it is possible to provide a sufficient mounting space for the goods receptacle, which is disposed above the engine in the vehicle. Thus, it is possible to expand the receiving capacity of the goods receptacle.

Figure 6:
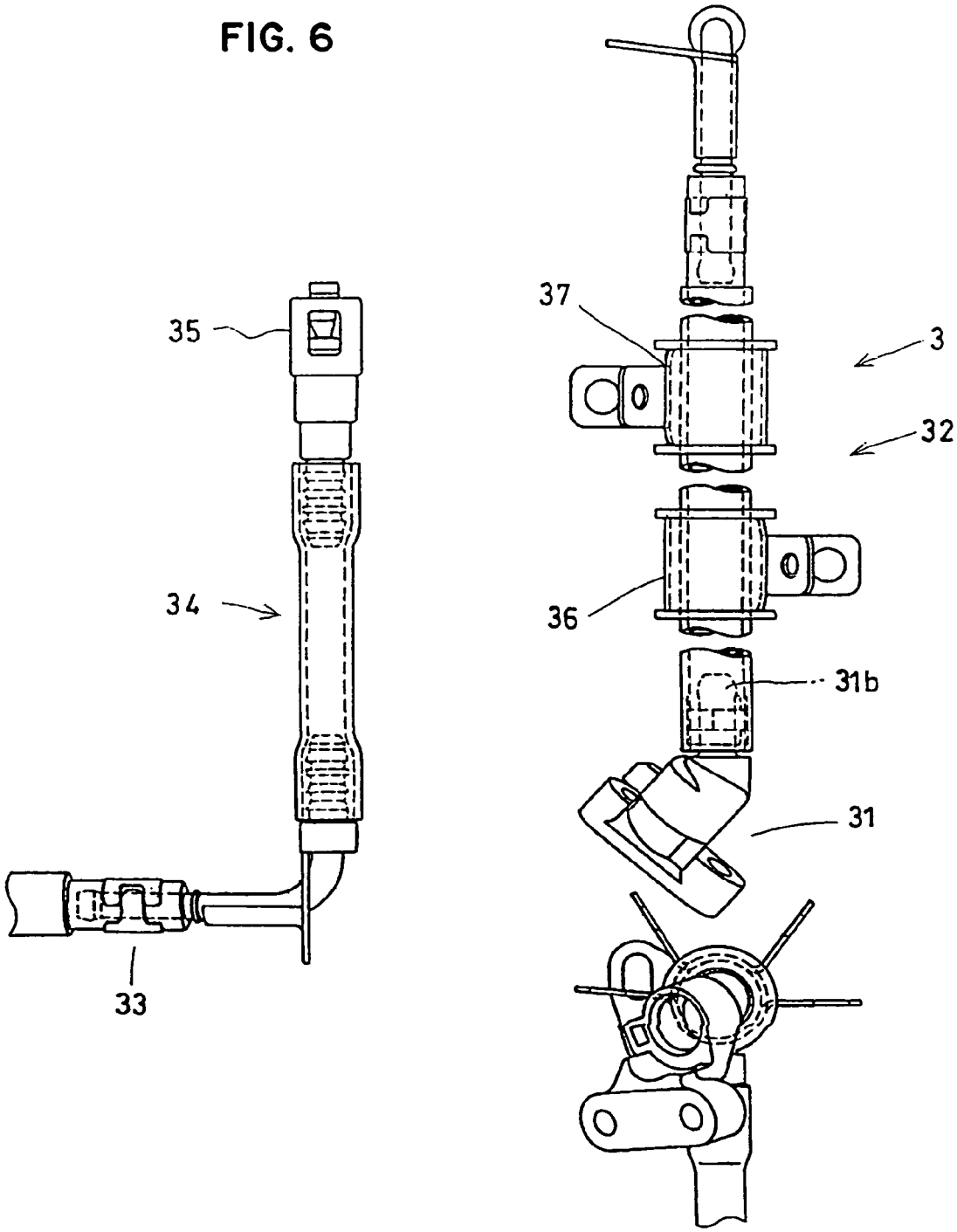
FIG. 6 illustrates a fuel supply hose according to the present invention.

The supply of fuel to the fuel injection device 14 mounted as above is performed through the fuel supply hose 3 connected to a connector 31*b*. The connector 31 extends upward (forward) from a holding portion 31*a* of the fuel injection device mounting member 31. The holding portion 31*a* holds the upper portion of the fuel injection device 14. The fuel supply hose 3, which has such a structure as shown in FIG. 6, includes the mounting member 31 having the holding portion 31*a* for holding the upper portion 14*d* of the fuel injection device 14 fittingly and the connector 31*b*, a relatively long hose portion 32 whose one end is fitted on the connector 31*b* of the mounting member 31, a fuel pipe 34 connected to an opposite end of the hose portion 32 through a joint 33, and a connector 35 for connection to a discharge port of the pump P in the fuel tank 50*k*, which is connected to the fuel pipe 34.

Figure 7:
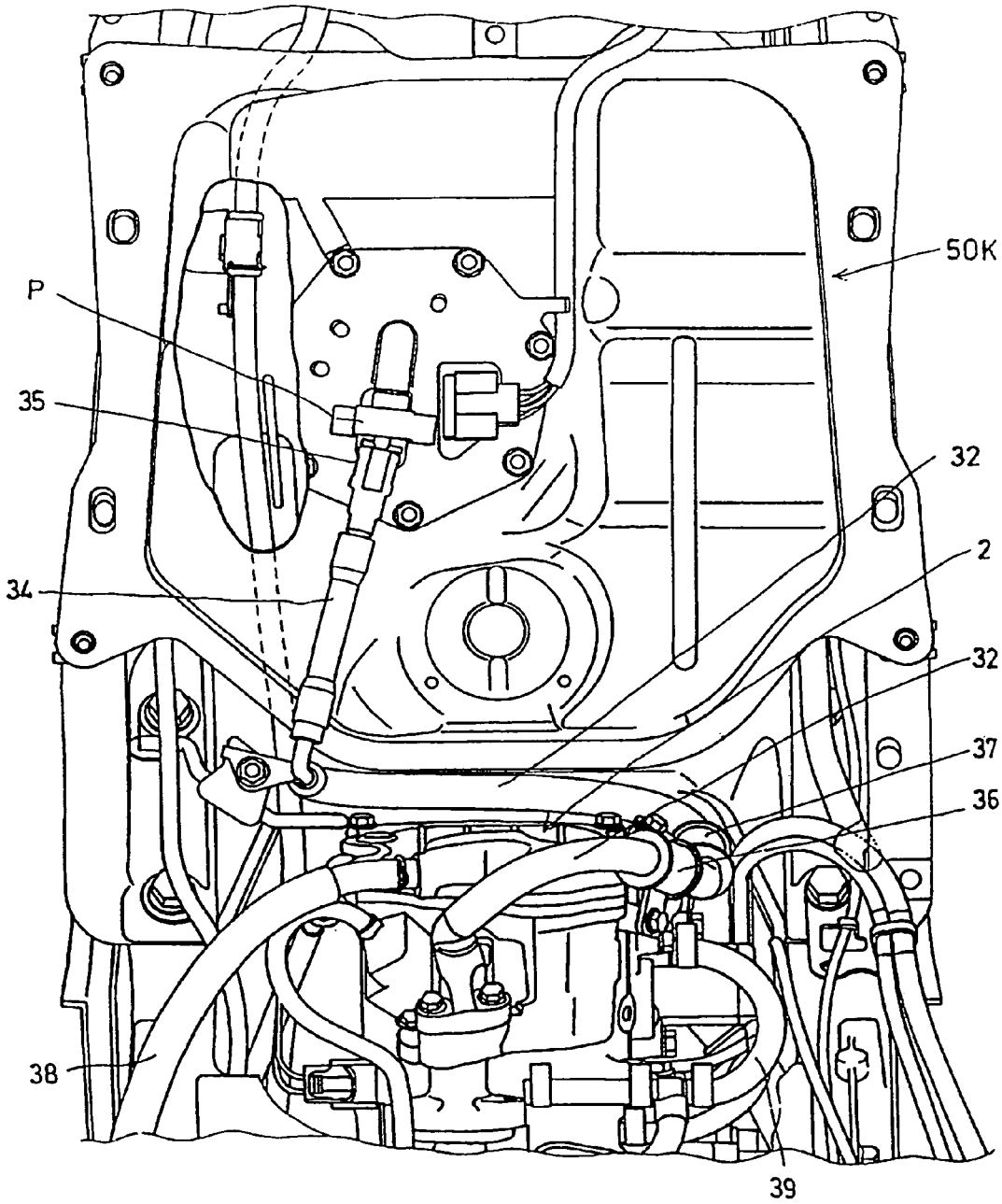
FIG. 7 is an enlarged view of a nearly central portion of the vehicle, illustrating in what state a fuel supply hose is disposed for the supply of fuel from a fuel tank to a fuel injection valve in the internal combustion engine according to the present invention.

As shown in FIG. 7, the fuel supply hose 3, which connects the fuel injection device 14 and the fuel tank 50*k* with each other, bends downward along the back side of the tank 50*k* from the fuel pipe 34 disposed on top of the fuel tank 50*k* (see also FIG. 1). Then, the hose 3 extends in the transverse direction of the vehicle and rises. Thus, the fuel supply hose 3 extends while curving along the front side of the cylinder head cover 2 and is connected to the connector 31*b* of the fuel injection device mounting member 31, which holds the upper portion 14*d* of the fuel injection device 14.

Figure 8B:
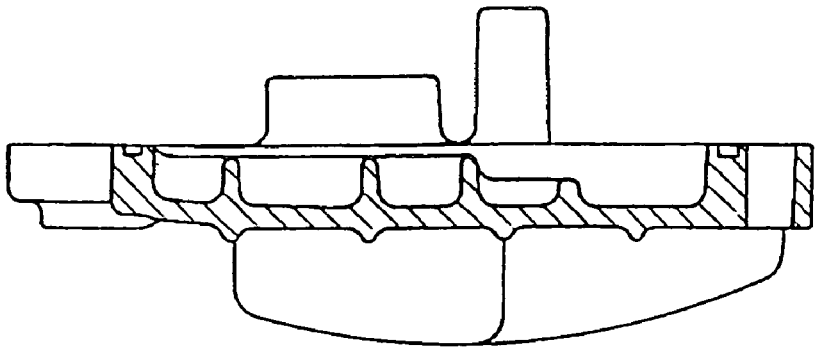
FIG. 8(*a*) illustrates a front view of a cylinder head cover according to the present invention.
Figure 8A:
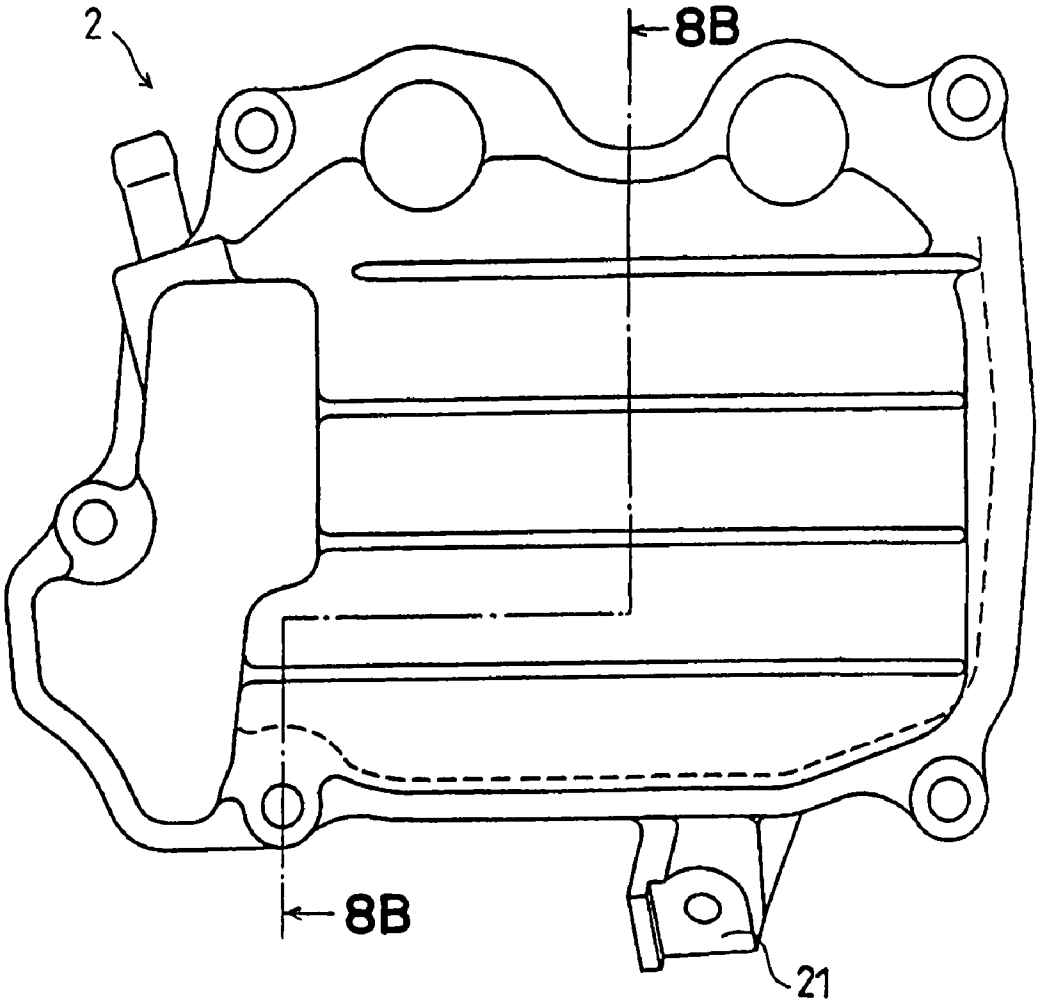

Numerals 36 and 37 denote clip members for holding the fuel supply hose 3. With the clip member 36, the hose 3 is held to the cylinder head 1 through the holding portion 17 (see FIG. 2) of the cylinder head 1. With the clip member 37, the hose 3 is held to the cylinder head cover 2 through a holding portion 21 (see FIGS. 8(*a*) and 8(*b*)) of the cylinder head cover 2. The clips 36 and 37 serve as vibration stop means for the elongated hose 3 upon vibration of the hose during vehicular running or engine operation. Although the hose 3 is held at two positions in this embodiment, suitable holding positions may be selected. Numerals 38 and 39 in FIG. 7 denote breather pipes.

Figure 10:
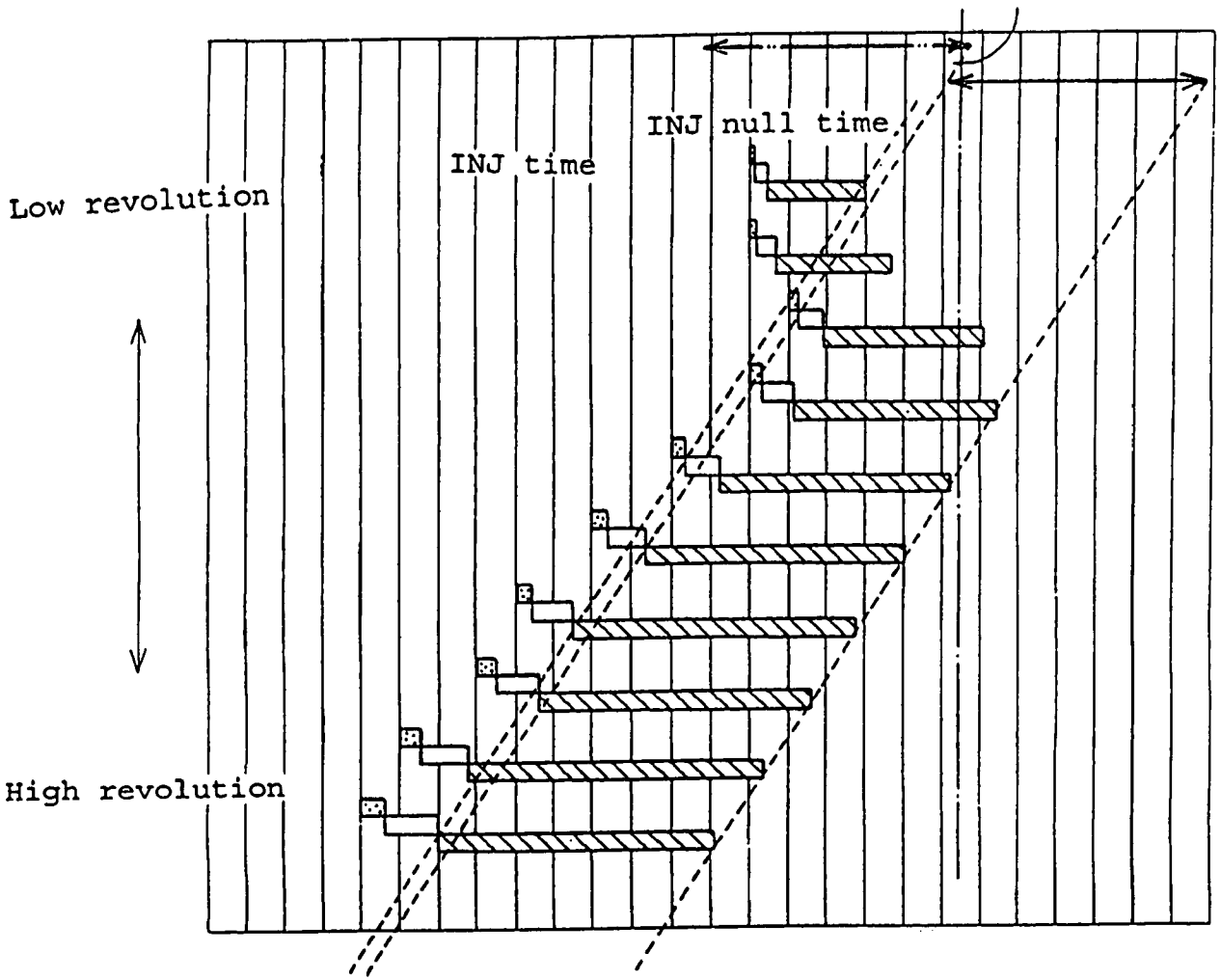
FIG. 10 is a diagram representing a relation between an injection time of a fuel injection valve and opening/closing operations of intake and exhaust ports performed by intake and exhaust valves in the internal combustion engine.
Figure 11:
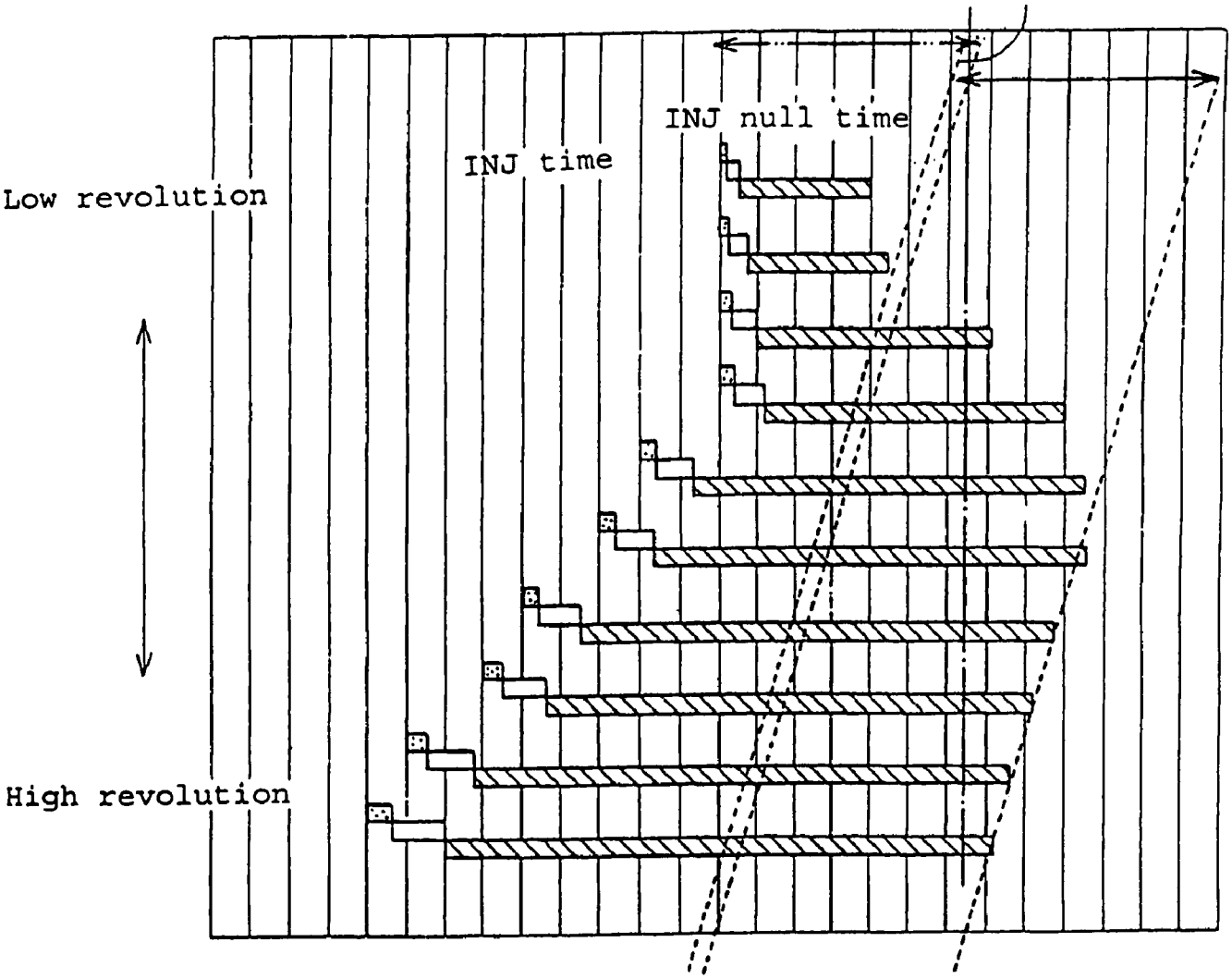
FIG. 11 is another diagram representing a relation between an injection time of a fuel injection valve and opening/closing operations of intake and exhaust ports performed by intake and exhaust valves in the internal combustion engine.
Figure 12:
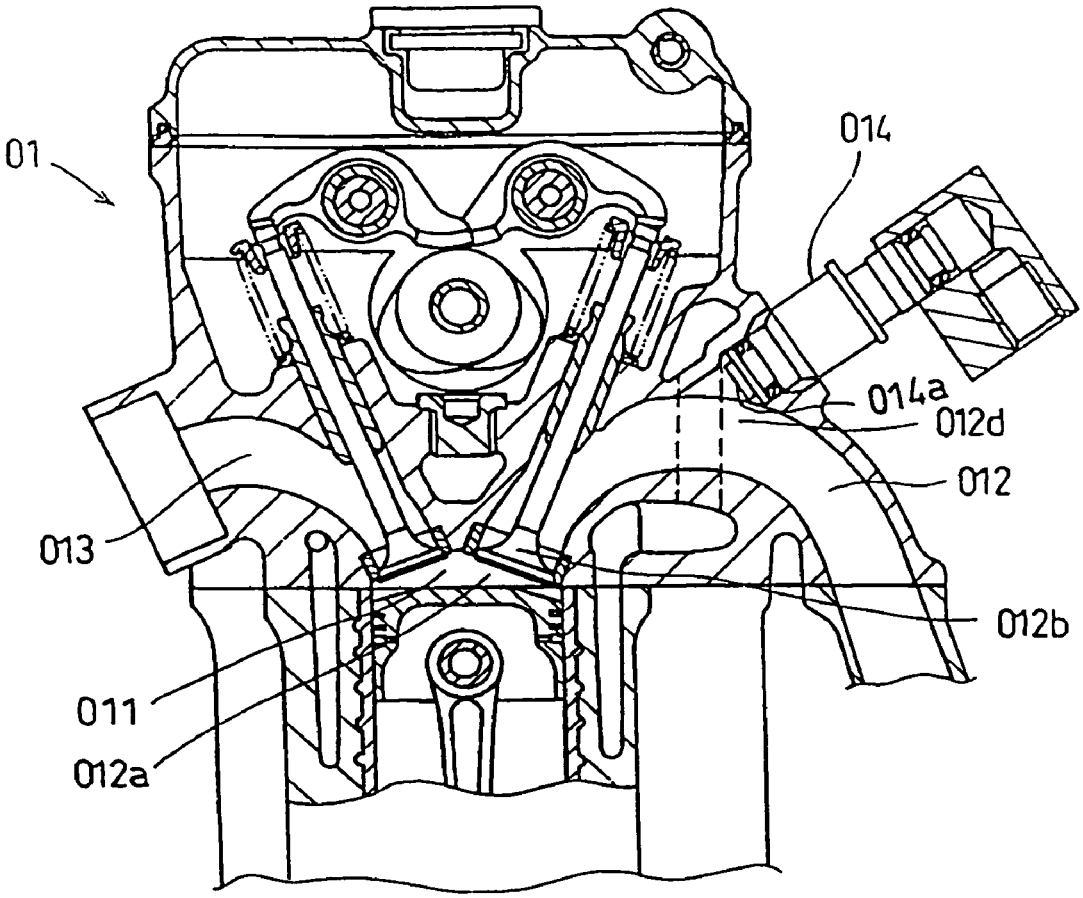
FIG. 12 illustrates an intake structure in a conventional internal combustion engine.

At the time of overlap of closing of the exhaust valve and opening of the intake valve just before the end of the exhaust stroke, as shown in FIGS. 10 and 11, if injected fuel stays near the intake port, the blow-through phenomenon of the injected fuel toward the exhaust port occurs almost simultaneously with opening of the intake port by the intake valve. As a result, unburned injected fuel is discharged from the exhaust passage together with the exhaust gas, and such a phenomenon may occur as an increase in the amount of HC contained in the exhaust gas.

As can be seen from FIG. 10, when the throttle angle is low (e.g., about 20 degrees), the injection of fuel by the fuel injection device scarcely overlaps the opening/closing overlap region of the intake and exhaust valves once the engine speed reaches a rotational region in which a shift is made from a low revolution region to a medium and high revolution region.

When the throttle angle is high (e.g., full open), as shown in FIG. 11, since the flow velocity of intake air is high, the whole quantity of injected fuel is introduced into the cylinder even if the injection of fuel by the fuel injection device is conducted to a later stage as indicated by the inclination in the high revolution region. However, since the start of fuel injection is expedited to ensure a sufficient amount of injected fuel, the fuel injection region overlaps the opening/closing overlap region of the intake and exhaust valves. Therefore, if the fuel injection device injects fuel directly toward the intake port, the amount of injected fuel blowing through together with blow-through of an intake air current increases to a greater extent.

However, in the embodiment of the present invention, in the exhaust stroke with the exhaust valve 13*b* open during operation of the engine E, the fuel injected from the injection port 14*a* of the fuel injection device 14, which faces the interior of the intake passage 12, is not directed directly toward the intake port 12*a* as noted previously. The injected fuel strikes directly against the inner wall of the intake passage 12 and stays within the intake passage 12 while assuming a state of fine mist. The injected fuel remains near the backside of the head portion of the intake valve 12*b* in the intake port 12*a*. Thus, it is possible to minimize the blow-through phenomenon of injected fuel at the time of opening/closing overlap of the exhaust valve 13*b* and the intake valve 12*b* just before the end of the exhaust stroke.

That is, in the embodiment of the present invention, by opening of the intake valve 12*b* just before closing of the exhaust valve 13*b* at the end of the exhaust stroke, intake air is introduced through the intake passage 12. First, the air around the intake port 12*a* is fed into the combustion chamber 11. Subsequently, misty fuel is fed into the combustion chamber 11 as follows. The injected fuel is injected toward the inner wall surface of the intake passage 12 and further atomized by collision with the wall surface. The atomized misty fuel, which remains near the curved top portion 12*d* in the intake passage 12, flows through the intake passage 12 together with the intake air and is fed into the combustion chamber 11 through the intake port 12*a*.

In the intake structure of this embodiment, since an air intake action is performed through the above process, it is possible to minimize the occurrence of the blow-through phenomenon of unburned injected fuel caused by flowing of intake air into the combustion chamber 11 upon opening of the intake valve 12*b* just before closing of the exhaust valve 13*b* at the end of the exhaust stroke.

Moreover, the combustion efficiency is improved, because the misty fuel staying near the curved top portion of the intake passage is introduced immediately following the air, which stays near the intake port.

The intake structure disclosed herein is applicable not only to the vehicle wherein the engine is installed horizontally, but also to a vehicle wherein the engine is installed vertically or nearly vertically. Also, the intake structure is applicable not only to the motorcycle but also to other vehicles as well.

What is claimed is:

1. An intake structure in an internal combustion engine, the intake structure comprising:

a cylinder head;

a combustion chamber in the cylinder head;

an intake port and an exhaust port defined by the combustion chamber, the intake port defining a valve axis;

an intake passage and an exhaust passage communicating with the intake port and the exhaust port, respectively;

an intake valve and an exhaust valve for opening and closing the intake port and the exhaust port in the intake passage and the exhaust passage, respectively; and a fuel injection device installed in the cylinder head, the fuel injection device defining a fuel injection orifice facing the intake passage and defining an injection axis, the fuel injection orifice being positioned in proximity to the intake valve for opening and closing the intake port, and the injection axis of the fuel injection orifice being generally parallel to and offset from the valve axis of the intake port.

2. The intake structure in an internal combustion engine according to claim 1, wherein the intake passage communicating with the intake port forms a U-shape.

3. The intake structure in an internal combustion engine according to claim 2, wherein the injection axis of the fuel injection orifice of the fuel injection device is directed toward a top portion of the intake passage.

4. The intake structure in an internal combustion engine according to claim 3, wherein the injection axis of the fuel injection orifice intersects the top portion of the intake passage at a predetermined angle.

5. The intake structure in an internal combustion engine according to claim 1, wherein the intake passage branches from a single intake passage into a plurality of intake ports, and the fuel injection orifice of the fuel injection device is positioned in proximity to the branched portion of the intake passage.

6. An internal combustion engine having an intake structure comprising:

a cylinder head;

a combustion chamber in the cylinder head;

an intake port and an exhaust port defined by the combustion chamber, the intake port defining a valve axis;

an intake passage and an exhaust passage communicating with the intake port and the exhaust port, respectively;

an intake valve and an exhaust valve for opening and closing the intake port and the exhaust port in the intake passage and the exhaust passage, respectively; and a fuel injection device installed in the cylinder head, the fuel injection device defining a fuel injection orifice facing the intake passage and defining an injection axis, the fuel injection orifice being positioned in proximity to the intake valve for opening and closing the intake port, and the injection axis of the fuel injection orifice being generally parallel to and offset from the valve axis of the intake port.

7. A vehicle, comprising:

a frame;

a plurality of wheels coupled to the frame; and an internal combustion engine including an intake structure, the intake structure including:

a cylinder head;

a combustion chamber in the cylinder head;

an intake port and an exhaust port defined by the combustion chamber, the intake port defining a valve axis;

an intake passage and an exhaust passage communicating with the intake port and the exhaust port, respectively;

an intake valve and an exhaust valve for opening and closing the intake port and the exhaust port in the intake passage and the exhaust passage, respectively; and a fuel injection device installed in the cylinder head, the fuel injection device defining a fuel injection orifice facing the intake passage and defining an injection axis, the fuel injection orifice being positioned in proximity to the intake valve for opening and closing the intake port, and the injection axis of the fuel injection orifice being generally parallel to and offset from the valve axis of the intake port.

8. The vehicle according to claim 7, wherein the intake passage communicating with the intake port forms a U-shape.

9. The vehicle according to claim 8, wherein the injection axis of the fuel injection orifice of the fuel injection device is directed toward a top portion of the intake passage.

10. The vehicle according to claim 9, wherein the injection axis of the fuel injection orifice intersects the top portion of the intake passage at a predetermined angle.

11. The vehicle according to claim 7, wherein the intake passage branches from a single intake passage into a plurality of intake ports, and the fuel injection orifice of the fuel injection device is positioned in proximity to the branched portion of the intake passage.

12. The vehicle according to claim 7, wherein the internal combustion engine having the intake structure is mounted on the vehicle such that a cylinder of the engine assumes a horizontal state.

13. A method for injecting fuel for an internal combustion engine, the method comprising:

providing an intake structure including a cylinder head, a combustion chamber in the cylinder head, an intake port and an exhaust port defined by the combustion chamber, the intake port defining a valve axis, an intake passage and an exhaust passage communicating with the intake port and the exhaust port, respectively; and an intake valve and an exhaust valve for opening and closing the intake port and the exhaust port in the intake passage and the exhaust passage, respectively;

installing a fuel injection device defining a fuel injection orifice facing the intake passage and defining an injection axis such that the injection axis of the fuel injection orifice is generally parallel to and offset from the valve axis of the intake port; and allowing the fuel injection device to inject fuel through the fuel injection orifice in a direction of the injection axis such that the fuel contacts a top portion of the intake passage, causing at least a portion of the fuel to become atomized.

14. The method according to claim 13, wherein the intake passage communicating with the intake port is formed in a U-shape.

15. The method according to claim 13, further comprising positioning the injection axis of the fuel injection orifice to intersect the top portion of the intake passage at a predetermined angle.

16. The method according to claim 13, wherein the intake passage branches from a single intake passage into a plurality of intake ports, and the fuel injection orifice of the fuel injection device is positioned in proximity to the branched portion of the intake passage.

17. The method according to claim 13, further comprising mounting the internal combustion engine having the intake structure on a vehicle such that a cylinder of the engine assumes a horizontal state.

* * * * *